United States Patent [19]

Anderson et al.

[11] 4,249,318

[45] Feb. 10, 1981

[54] BASIC COLOR MEDIA SET FOR PROVIDING TONALLY MATCHED PALETTES

[76] Inventors: Martin C. Anderson, 2265 N. Oxford Rd., Oxford, Mich. 48051; David T. Lonier, 1312 N. Woodward, Bloomfield Hills, Mich. 48013

[21] Appl. No.: 43,279

[22] Filed: May 29, 1979

Related U.S. Application Data

[63] Continuation of Ser. No. 792,149, Apr. 29, 1977, abandoned.

[51] Int. Cl.[3] ..... B44D 3/00

[52] U.S. Cl. ..... 434/103; 211/78

[58] Field of Search ..... 35/28.3, 28.5, 55, 56; 206/1.7, 1.8, 1.9, 81; 211/70, 77, 78

[56] References Cited

U.S. PATENT DOCUMENTS

| | | | |
|---|---|---|---|
| 824,374 | 6/1906 | Munsell | 35/28.5 |
| 1,119,702 | 12/1914 | Infield | 211/78 UX |
| 3,125,385 | 3/1964 | Friedman | 35/56 X |
| 3,275,159 | 9/1966 | James | 211/78 X |
| 3,628,260 | 12/1971 | Jacobsen | 35/28.5 |
| 3,777,414 | 12/1973 | Robinson | 35/28.5 |
| 3,815,265 | 6/1974 | Depauw | 35/28.5 |

OTHER PUBLICATIONS

Color Chart, page 30 of "How to Draw and Paint Seascapes," Number 9 Art Book by Walter Foster, Tustin, Calif. 92680, prior to May 25, 1976.

*Primary Examiner*—Harland S. Skogquist
*Attorney, Agent, or Firm*—John R. Benefiel

[57] ABSTRACT

A premixed basic color media set is disclosed, the basic set including coloring media varying through a spectral range of selected hues, which can be grouped to create palettes of tonally related source colors for use in rendering color compositions by artists. The palettes so created vary through a spectral range of tonal influences. The basic set of coloring media is based on the derivation of a limited number of colors, including a selected group of primary colors, here disclosed as the artist's red, yellow and blue, and those essentially different colors resulting from illumination or toning of these primary colors through a spectral color range of illumination. Physical arrangements of coloring materials and associated color charts are provided to facilitate use of the premixed coloring materials when grouped into tonal palettes. Also disclosed is the provision, both on the color charts and in the arrangements of coloring materials, of graduated values of each color of the basic set to substantially eliminate the need for lightening or darkening of the color materials, and to aid in effective mixing of the coloring materials of a selected palette in deriving other colors in rendering a painting or other work.

24 Claims, 11 Drawing Figures

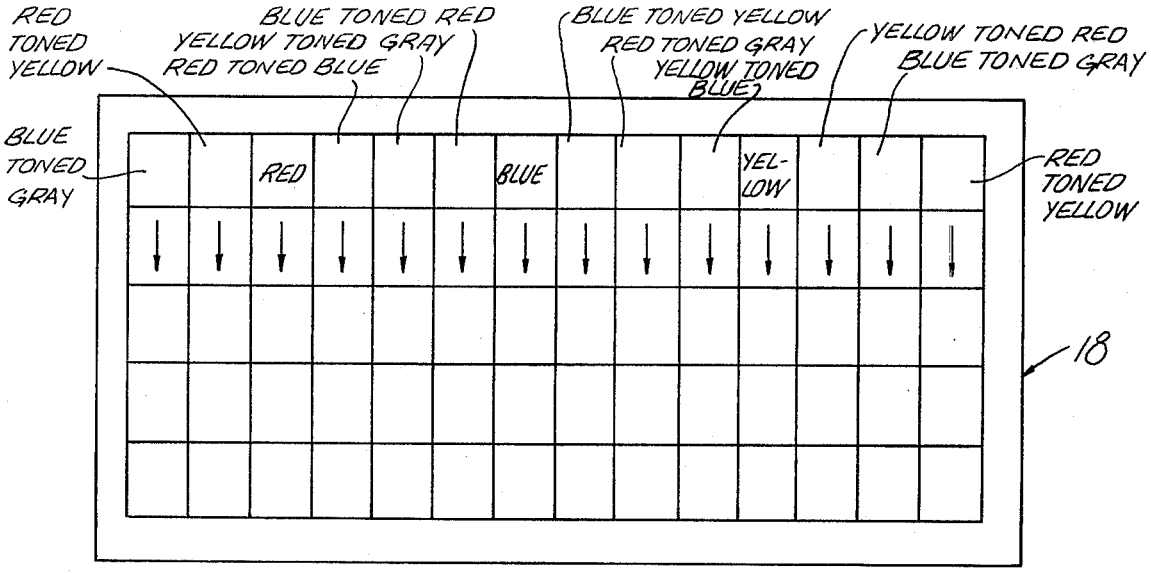
Fig-6
Fig-8
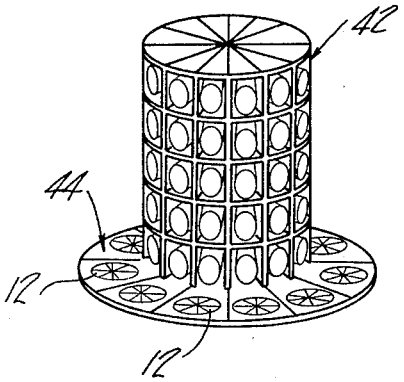
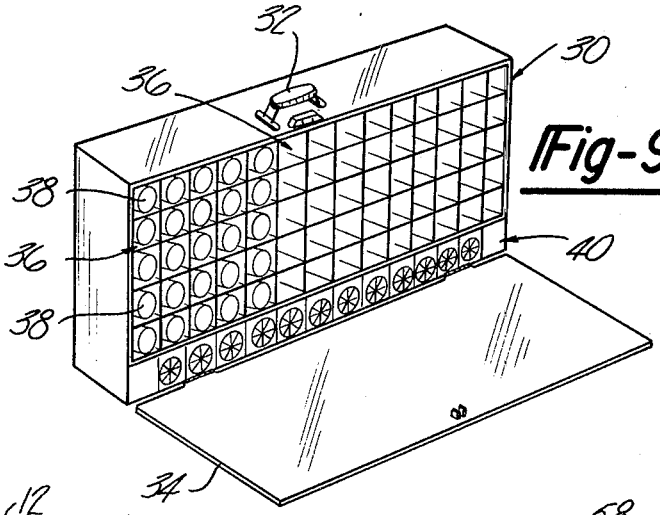
Fig-9
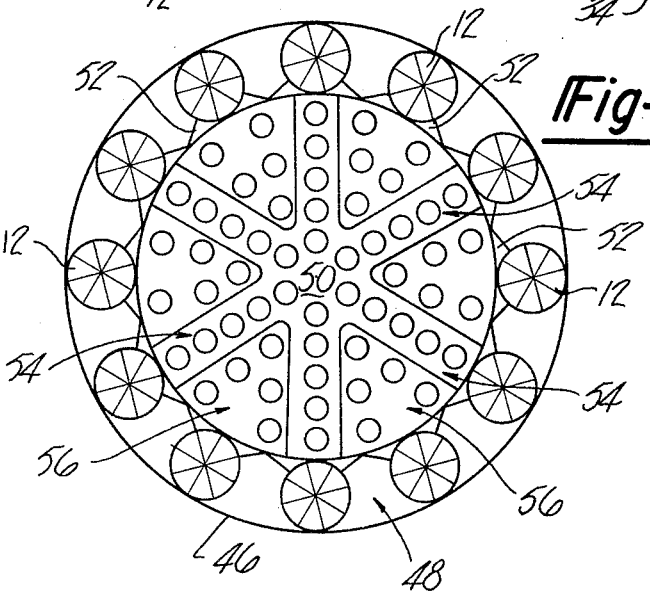
Fig-10
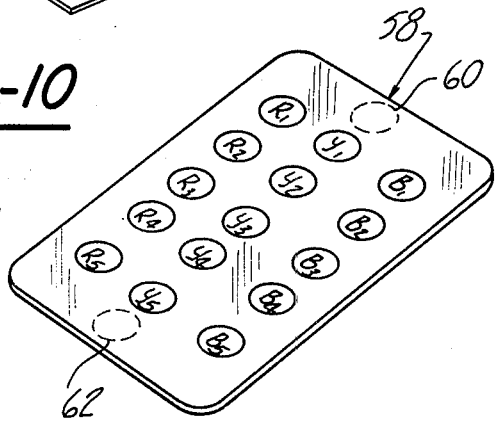
Fig-11

BASIC COLOR MEDIA SET FOR PROVIDING TONALLY MATCHED PALETTES

This is a continuation of application Ser. No. 792,149, filed Apr. 29, 1977, now abandoned.

BACKGROUND OF THE INVENTION

1. Field of the Invention

This invention concerns broadly coloring materials for the production of color compositions such as paintings and other works, and more particularly is concerned with a basic color media set including color charts and premixed coloring materials to enable the ready preparation of a full spectrum of properly toned palettes.

2. Description of the Prior Art

In the rendering of paintings and other works involving color composition, the artist or colorist is generally concerned with producing compositions which are pleasing to the eye, and in many instances he also may be concerned with reproducing a natural scene. The use of coloring materials towards this end is difficult, since many complex and subtle factors are involved in producing such a work which is natural and pleasing to the eye. These include optical factors, i.e., those relating to the nature of light and its properties in the context of color, and also visual or perceptive factors relating to the functioning of the eye and the associated brain centers.

As to what is pleasing to the eye, it has been found that simply using masses of bright and contrasting color does not produce an effective color work, since any attempt to assault the eye with color generally results in a reaction of the visual-perceptive faculty tending to reduce the contrast and brilliance, and such a work is lacking in appeal.

Color appeal is produced by a number of factors, some of which relate to certain subtle enhancement effects of the eye when viewing color areas. When these enhancements are created, the result is a more eye-pleasing composition.

A well known example of these factors is the interaction occurring upon juxtaposition of areas of complementary colors. Complementary colors are those colors which when blended together tend to neutralize each other and produce a white light, in the context of an additive process, i.e., a process in which colored lights are combined. In the context of a subtractive process, these colors will produce gray tones, subtractive process being those coloring processes involving combinations of materials each of which selectively absorbs particular wave lengths of color of light, to thus exhibit a characteristic of the remaining reflected colors.

In these situations where complementary colors are juxtaposed, the eye-brain perceptive faculty tends to attempt to combine the colors, which attempt enhances the brilliance of the colors, and produces an interest or appeal to the eye. This interest has been termed "visual entertainment".

Another such factor is that involving the juxtaposition of areas of contrasting brightness or "value", value being the characteristic of a surface which controls the relative intensity of light reflected from the surface. In those instances where areas of equal value or of similar value but different color are juxtaposed, the eye tends to seek a value contrast, and where it does not exist, the eye again tends to enhance the color difference between the juxtaposed areas so that areas of similar value tend to exhibit enhanced color brilliance. This effect also tends to produce a pleasing effect in the resulting color composition.

Another such "visual entertainment" phenomenon is concerned with the tendency of the visual perceptive faculty to produce the complementary of a color when a strong color is viewed, which effect can be readily produced when the light with which a scene is illuminated is strongly colored. An example of this latter visual phenomenon is the oft-cited example of the effect of viewing a winter scene in a twilight lighting. The scene appears entirely gray, but upon lighting within of an incandescent-type lamp having an orange tone, the viewed outside scene tends to be imbued with a bluish cast which is the complementary color of the incandescent orange-toned light. Thus, if a scene is rendered in a color composition with an overall dominant color, its complementaries tend to glow in this context due to the enhancement thereof by the described visual factor.

Such a color dominance in a scene may come about in a natural scene in the hue of the illumination of the scene, as described. This fact involves an example of an optical factor which must be considered by the colorist. The color of an object is produced by its selective reflectivity, that is certain wave lengths are reflected while others are absorbed. Those that are reflected give the object its characteristic color. Obviously the color of the illuminating light will have some influence on the color of the object, since the nature of the reflected light will vary with the wave lengths of the illuminating beam.

On the whole, this is what produces a "tonal" influence i.e., the bathing of a scene in a deeply red illumination, such as occurs in certain sunset conditions will modify the colors perceived in a scene from those colors which will be observed in the full daylight, i.e., greens will be grayed, etc. Since most scenes are viewed under the influence of a characteristically colored illuminating light, natural scene colors, as viewed in the scene, are thus toned and all of the colors of the spectrum (and combinations thereof) which should chance appear in that scene would be somewhat modified from their appearance under pure white light. This modification would involve the purely optical factor referred to, in that a definite toning will take place under illumination by a particular color which will tend to consistently shift each of the spectral colors in a definite way. It is this consistency of colors appearing in a natural scene which must be reproduced by the artist if the scene is to appear natural in his rendition of the same.

Thus, most successful art work by experienced and talented painters has involved a selection of colors in a rendering of a scene or a painting or a similar work which are actually related by this tonal influence, the resulting tonal dominance also tending to enhance the visual entertainment provided by the color composition, so that such a work both appears more natural and also is much more pleasing to the eye. These factors, of course, are not readily appreciated or understood by beginners and those relatively untutored in the art of color composition and thereby the quality of the works they produce suffers as a result.

Even for the experienced and those fully aware of these factors, the achievement of this tonally balanced composition has involved tedious premixing of suitable source coloring materials for use in preparing a palette of source colors which may take a considerable length of time in preparing for execution of the painting. In addition, the mixing of these coloring materials has not been on a systematic basis and has more or less relied on the instinct and eye of the artist. There are limitations in this approach in that the toning of the source colors can only be executed within the finite capability of the eye to distinguish tones such that the toning of the source colorings cannot be carried out with a degree by eye examination alone to maximize the effects sought in combining the colors in the composition. That is the distinctions between the colors taken alone is not within the perceptive powers of vision, the variation and effect only being apparent upon juxtaposition in the completed work.

Furthermore, the practice has been to utilize a relatively great number of source colorings, increasing the time factor involved and, if the quantity of paint which is mixed is not sufficient to complete the work, it may be difficult for the artist to mix another quantity of the paint precisely of the same hue and value. The typical artist may also typically have on hand a relatively large number of pigments for mixing source colorings which do not have a systematic relationship to each other requiring the artist to more or less depend upon instinct and eye perception alone in arriving at his source colorings.

Another practical difficulty encountered by beginning and experienced artists alike is the problem of lightening and darkening the coloring material of a given hue by the addition of white or black. It is an extremely difficult process to attempt to properly vary value in a hue which is aggravated by the influence of ambient light on the value exhibited by a given color. That is, under warm light blues will be darkened, for example; under blue light, warm colors will be darkened, so that a mean must be struck in attempting to match a value.

It is accordingly an object of the present invention to provide a system for producing a spectral range of tonally related source color groupings or palettes suitable for rendering color compositions influenced by a selected tonal factor.

It is a further object of the present invention to provide in the context of paintings and other similar works a premixed basic set of coloring materials which may be grouped to produce palettes from which may be derived other colors so that all colors so produced will show the influence of the tonal factor without the need for toning by the artist.

It is yet another object of the present invention to provide a relatively small number of basic or essential coloring materials from which a large number of such palettes may be prepared with tonal influences extending throughout the spectral range.

It is still a further object of the present invention to provide systematic arrangement of such basic coloring materials so as to enable the colorist to quickly select those basic coloring materials necessary for providing a palette of a given tonal influence.

It is yet another object of the present invention to provide a color chart which is in correspondence with the physical organization of coloring materials and which provides an associated color wheel for many of the tonal palettes which may be provided by the basic coloring materials.

It is another object of the present invention to provide a premixed quantity of such basic coloring materials through a graduated range of values, so as to substantially eliminate the need for the use of white or dark coloring to lighten or darken the basic colors and also to further aid in the production of both tonally and value matched mixtures of the basic coloring materials.

It is yet another object of the present invention to provide a color chart arrangement in which a series of corresponding artist's color wheels corresponding to each tonal palette may be arranged in the same ordered relationship as in an individual artist's color wheel enabling the artist to readily understand the relationship between the various tonal colorings.

It is still another object of the present invention to provide a physical storage arrangement which compactly stores the premixed coloring materials in a relationship which aids in the ready selection of these coloring materials in preparing a given selected tonal palette.

It is yet another object of the present invention to provide both physical organization and color chart arrangements incorporating the graduated values of basic coloring material to enable value matched mixings of the basic coloring materials to be facilitated so as to greatly reduce the time required in mixing source colors in rendering of a work involving color composition.

SUMMARY OF THE INVENTION

These and other objects of the present invention are provided by providing a basic coloring media set comprised of three primary colors disclosed as red, blue and yellow coloring media, and those primary colors as they are modified by the influence of a spectral range of tonal influence, i.e., of blue, green, yellow, orange, red, violet, to yield a basic group of coloring media comprised of twelve essentially different colors. Coloring materials or media in these basic colors are visually associated as by being organized in both a color chart arrangement and a physical arrangement in a sequenced array of the coloring materials, such that successive groupings of three of these coloring materials create a palette which is tonally matched. The arrangement further provides successive changes in tonal influence proceeding through the series varying in a spectral order, i.e., the yellow tonal palette is followed in one direction by the green toned yellow palette and in the other direction by the orange toned yellow palette, and so on in either direction. This arrangement allows artist color wheels to be associated with the color chart location corresponding to each basic color which artist color wheel illustrates both the color of the tonal influence and a spectrum of colors which may be created by blending of the basic color at that location with the two adjacent basic coloring materials located on either side of the given basic coloring material location. With this arrangement, the artist's color wheels vary through the series in a spectral order to provide a clear illustration of the relationship of the tonal factors throughout the spectral range of such tonal factor with each other.

In addition, each basic color, both as it appears on the color chart and in the physical organization of coloring materials, is provided in a graduated, varying value level along a transverse direction to that in which the color varies in the array of color samples and coloring materials.

The physical means for arranging the coloring materials and the associated color chart includes a circular or carousel storage unit in which the coloring materials are stored at circumferentially spaced locations, while the varying value of these are stored along storage locations axially spaced therefrom. A rectangular array is also provided with the basic color materials arranged along one axis and varying values of each basic color materials stored along a second orthogonal axis. Color charts are associated with each of the physical organizations and located so that corresponding coloring material samples are identified with the various color and value variations of each of the basic color materials.

BRIEF DESCRIPTION OF THE DRAWINGS

FIG. 6 is an alternate form of the color chart according to the present invention.

FIG. 8 is another variation in physical arrangement providing for storage of the coloring materials implementing the system according to the present invention.

FIG. 9 is a perspective view of an alternate version of the storage unit for use in organizing and implementing the system according to the present invention.

FIG. 10 is yet another plan view of another alternate form of a storage arrangement for implementation of the system according to the present invention.

FIG. 11 is a perspective view of a representation palette as prepared with the premixed coloring materials according to the present invention.

DETAILED DESCRIPTION

Figure 1:
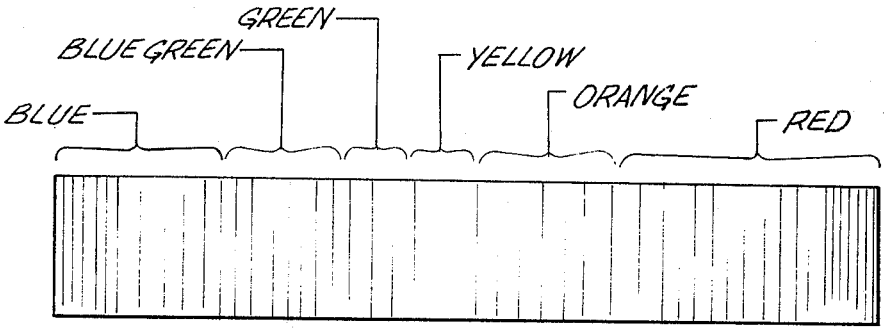
FIG. 1 is a diagrammatic representation of a spectral color range in linear form.

In the following detailed description certain specific terminology is utilized for the sake of clarity and specific embodiments described in accordance with requirements of 35 USC 112, but it is of course to be understood that the same is not intended to be limited and should not be so-construed, inasmuch as the invention is capable of many forms and variations in the scope of the appended claims.

As set forth above, in the description of the prior art, a major object of the present invention is to provide the artist with a system and materials for preparing palettes, each palette containing a source color grouping for mixing of the range of colors to be employed in the artist's work. The term palette, as used in this context, refers to such source color groupings, rather than to the physical support for such color groupings.

This object contemplates the providing of the toned palettes as described through a spectral range of toning colors. It is, of course, understood that the number of possible colors based on combinations of the spectral colors is infinite. Similarly, each of these colors could be illuminated by light of an infinite number of varying hues, so that the combination of colors and toning influences is likewise infinite. The approach of the present invention is to provide a limited number of such toned palettes which are of maximum utility and which essentially cover the entire spectral range of possible tonal colors to provide a reasonable number of premixed coloring materials, while being capable of rendering all of the basic tonal qualities which might be desired.

The basis on which the basic colors according to the present invention are derived has for its starting point a selection of a group of "primary" color media, for inclusion in the basic color media set. The term "primary color" has at least two different meanings in different contexts: First, it's used to describe certain colors, i.e., primary colors which may be chosen from which all other colors may be derived by various mixtures of these primary colors. In this sense there are no true primary colors, since there is no finite number of colors from which all other possible colors may be derived theoretically. However, in the additive mixing process, in which light is mixed of various colors to produce light of the combined effect of the various component light colors, the three colors from which the maximum number of colors may be derived are red, blue and green. In the subtractive process where materials such as oil paints are mixed which selectively absorb light of differing wave lengths to create a particularly colored surface, the primary colors are chosen as the traditional primaries of red, yellow and blue. Due to the inherent darkening in the subtractive process for the addition of each paint, green cannot be used as a satisfactory primary in this context since all of the spectral colors could not be produced by mixtures of these primary colors due to the impossibility of producing yellow.

In the second sense, the primary colors are those colors which cannot be produced by combinations of other colors and in this context of the subtractive process involving pigments, the primary colors are again red, blue, and yellow.

Thus, as an example of the application of the concept of the present invention, as particularly applied to the subtractive process, and as particularly applied to artist's supplies, the primary color grouping of three colors is initially selected as a red, a blue and a yellow color.

As a next step, each of these primaries are toned toward each of the other primary colors, to produce secondary color media for inclusion.

Figure 2:
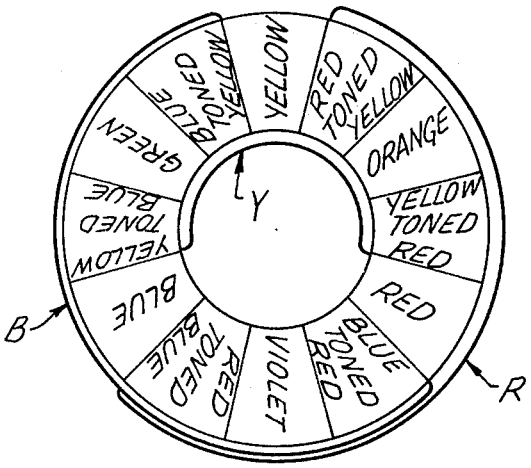
FIG. 2 is a diagrammatic representation of a spectral color range which has been formed into an overlapping circular form.

To explain the significance of the inclusion of the toned primary or secondary color media in the basic color media set, reference is made to FIGS. 1 and 2.

FIG. 1 is a diagrammatic representation of a spectral color range, at the one end are the blue colors blending into a green range with a central yellow band blending into an orange range and thence into a red band of colors in the usual spectral order. This color diagram is commonly bent around into a circle to produce the familiar artist color wheel which places the color areas of complementary colors in opposite locations about the wheel to provide a device for the artist's reference. It is, of course, true that the colors occurring in regions intermediate the primary colors of blue, yellow and red can be produced by combinations of the primary colors at either end of the intermediate color range. For example, all the spectral greens can be produced by blends of various shades of blue and yellow. Similarly, between yellow and red various orange hues are produced by the influence of red over yellow. In this instance, the intermediate orange tone ranges into a slightly red-toned yellow at the one end of the region into a yellow-toned red at the other.

FIG. 2 presents this in the format of the color wheel in which segments of the wheel can be considered as regions of primary tonal influence which are defined corresponding to these regions of primary color tonal influence over each other. The yellow region is identified as the "Y" segment, defined as those color regions represented by the various segments of the color wheel of varying hue ranging in one direction from a yellow to a red-toned yellow in which the yellow color predominates through an orange in which there is an approximate equal color influence of red and yellow into a yellow-toned red which is predominantly red influenced slightly by the yellow toning influence. In the other direction the region extends from a blue-toned yellow to a green range, to a yellow-toned blue.

Similarly, the blue range B extends from the segment just counterclockwise of the yellow segment which is represented as blue-toned yellow through green and at the other end of the spectrum a red-toned blue, through a violet to a blue-toned red at its other end.

The red range R extends on either side of a central pure red segment to the red-toned yellow segment on one side and back to the red-toned blue at the other extreme point.

According to the present invention the tonal palettes for the blue, red and yellow, respectively, are provided by selecting primary colors from the range of colors which occur in each of these primary influenced color ranges. That is, for the blue palette a blue-toned yellow is selected, a pure blue and a blue-toned red. Thus, the palette so-constituted contains three "primary" colors. That is, three colors from which a spectrum or tonal family of colors can be produced, as that spectrum is influenced or "toned" by the blue coloring, to thus provide a blue-toned palette.

The other colors needed can, of course, be mixed from these colors, each of the colors so mixed being inherently toned by use of the toned primaries.

The red and yellow palettes are likewise produced from primaries selected from the range of those colors' influence, including colors at the end points of their respective ranges. Of course, possible tonal colors extend throughout the spectrum and a reasonable selection of tones should extend beyond merely the primary three.

Figure 3:
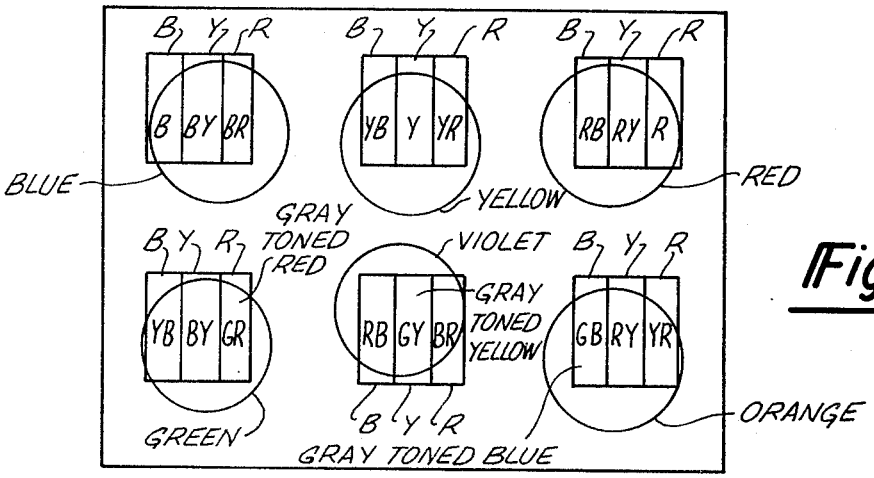
FIG. 3 is a diagrammatic representation of the influence on the color of three primary colors by illumination through a range of spectral colors on the three selected primary colors.

By reference to FIG. 3, it can be understood how this concept may be extended by considering the effect on each of these primary colors under the tonal influence of other colors in the spectral range, that is colors which are essentially different colors from the primary colors, i.e., the secondary colors of orange, green and violet. The circles represent areas of various tonal influencing colors in each of the circles, while the three area groupings represent the areas of each of the primary colors, blue, yellow and red. The upper three circles represent the primary color toning on each of these primary color groups, i.e., red, yellow and blue and the resulting colors are those discussed in reference to FIG. 2 in arriving at primary-toned palettes.

The lower three figures represent the tonal effect of illumination by the secondary colors of orange, violet and green. It has been found that the number of basic coloring materials may be reduced from the 18 different colors which may be theoretically produced in FIG. 3. This is so because only three additional essentially different colors are produced by the illumination of the primaries by the secondary colors. This is a result of the nature of these secondary colors in which they are produced by components of the primary colors, so that illumination of a primary color by a secondary color containing a component of that primary color yields a color which is essentially a toned primary of the remaining component of the secondary color. For example, a green illumination of the primary blue produces basically a slightly yellow-toned blue, since the blue component in the green would produce no substantial toning influence on the primary blue. While the shade would be somewhat different, it would still essentially be a yellow-toned blue and it is only this characteristic which need be met in order to render the coloring material useful as a source color in a palette grouping. The essentially different colors are produced by illumination of one of the primaries with a secondary neither of which components are contained in the illuminated primary. This yields a tertiary or grayed primary resulting from the effective combination of all three primary colors. Thus, the orange illumination of blue produces a gray-toned blue, a violet illumination of yellow produces a gray-toned yellow and a green illumination of red produces a gray-toned red. Thus, taken together, the colors developed above in the discussion of FIG. 2, and these three grays yield a basic color grouping from which a tonal palette may be derived with the tonal influence extending through the full spectral range.

According to a second development provided by the present invention, these basic color materials are organized in an array of coloring materials in which the positioning of the coloring materials is such that successive groupings of three of these basic coloring materials or compositions yields a source color grouping which is comprised of a tonal palette, the series of palettes range through the spectrum. By this arrangement a total of twelve tonal palettes may be directly derived from these basic color groupings. This provides a visual identification means for associating groups of the coloring material quantities in tonally related palettes, each palette consisting of a primary color set as it would be influenced by a spectral range of colors.

In addition, the arrangement of these coloring materials in the array and also a corresponding color chart to be described is such that the physical position of each palette varies in a spectral order. This allows the creation of a corresponding color chart in which artists' color wheels associated with each tonal palette may be located to form a larger artist's color wheel in which the tonal influence colors varies in the similar fashion to the conventional artist's color wheel.

Figure 4:
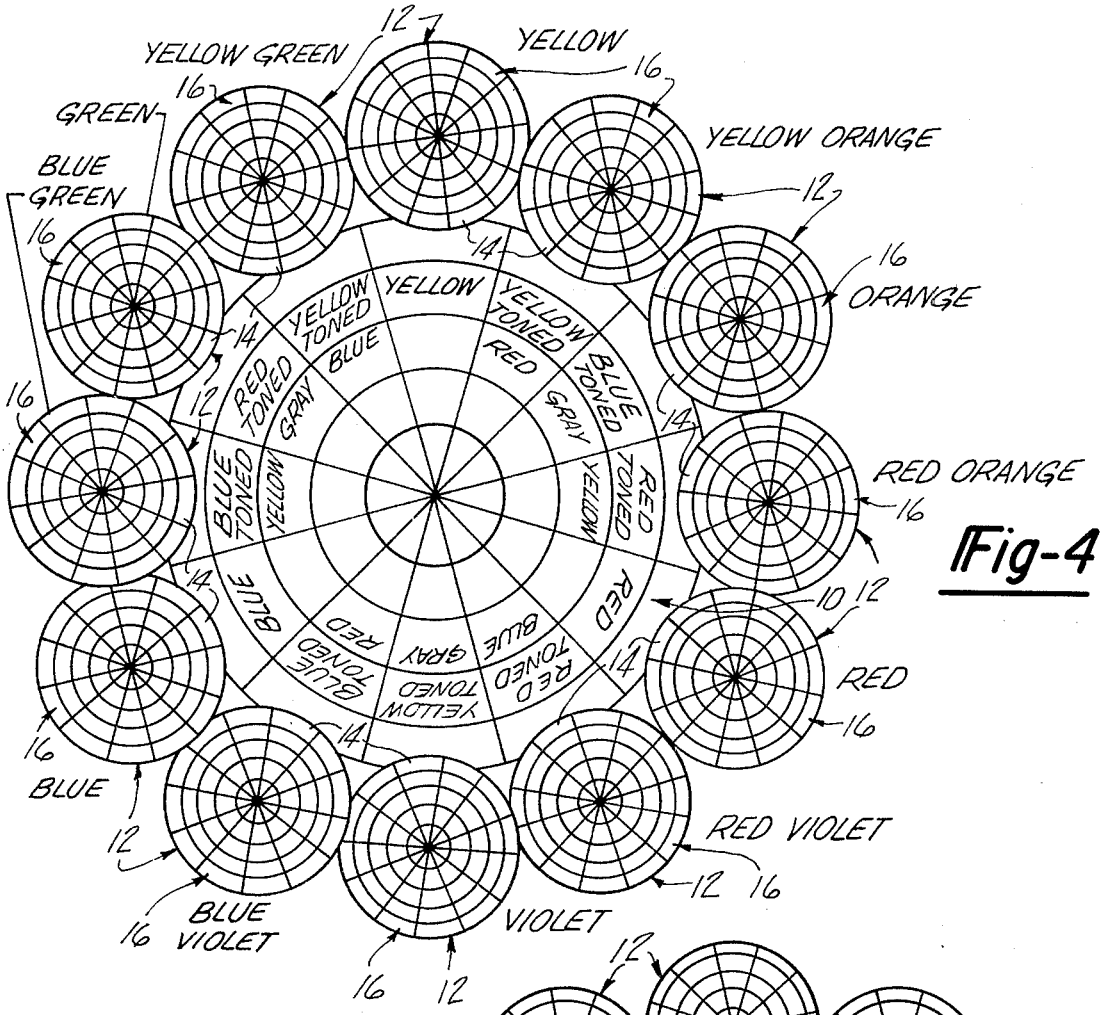
FIG. 4 is a diagrammatic representation of a first embodiment of a color chart according to the present invention.

This can be best understood by reference to FIG. 4 in which is a diagrammatic representation of the color chart which is contemplated as being physically associated with the array of coloring materials.

At this point it should be disclosed that the concept of the present invention further includes the provision of various value gradations of each of these basic colors described above to further minimize or eliminate completely the need to lighten or darken any given color by the addition of white or black pigment. Such a procedure is extremely difficult and requires considerable experience and is very often not successfully carried out by the amateur or novice artist. The above-described phenomenon of the value variation depending on the color of the illumination being one factor contributing to such difficulty.

In addition, the above-described phenomenon of close value matching between juxtapositioned color areas produces visual entertainment due to the color enhancement factor, and the ability to produce closely value-matched colorings by mixtures of value-matched source colors would be a substantial aid to the artist, particularly to the novice and the amateur. Of course, the time involved is also substantial and having premixed value variations of these colors would substantially speed the process and also make the process more enjoyable.

Towards this end, the basic color media set of the present invention provides five value variations of each of the basic twelve media colors, so that a total of sixty media colors are utilized from which the range of toned palettes may be created.

Referring to FIG. 4, a color chart is presented in diagrammatic form comprised of a central circle 10 which is surrounded by smaller circles 12. The central circle 10 is subdivided into twelve segments, as shown, and is further subdivided by five concentric smaller circles. Each of the resulting sections or areas is colored with samples of one of the basic colors arrived at above with the varying values of this color ranging from light at the interior to darkest at the outer periphery of the central circle 10. The circumferential order of the basic colors is important in their relationship to the tonal palettes which are produced so as to be able to be combined in successive groupings of three of the colors with which each segment is colored to form a tonally matched palette comprised of those three basic colors.

This circumferential relationship is, as noted, also ordered to enable the tone variation in the palettes so organized to vary about the central circle 10 in a spectral order or the same order as that of the conventional artist's color wheel.

These color locations are as labeled with the primary toned palettes being grouped together, as shown. The yellow-toned palette at the upper righthand grouping of segments comprised of the upper quadrant segments which are the yellow-toned blue, the yellow and the yellow-toned red, as indicated, and in the lower righthand grouping of segments, the red-toned palette comprised of red-toned blue, red and the red-toned yellow. The blue palette is provided by the blue-toned yellow, blue and the blue-toned red. The tertiary or toned-gray colors then are positioned intermediate each of the primary palettes, the yellow-toned gray being intermediate to red and blue-toned palette groupings and the blue-toned gray being intermediate the yellow and red palettes and the red-toned gray intermediate the yellow and blue-toned palette grouping. According to the present invention, the ordering of the colors is such that each successive group of three includes three colors which comprise or are related respectively to the three different primary colors, so that each group may be utilized as a source color palette.

This ordering includes locating each pure primary color interposed between the two secondary colors composed of the other two primaries toned towards that primary. In addition, each tertiary color is located intermediate those primary groupings which are unlike the tonal factor in that tertiary. That is, the red-toned gray is located intermediate the yellow and blue palettes, and so on. Finally, the secondary colors are arranged so that each secondary color sample is positioned next to that tertiary having a tonal color unlike either the pure primary as the primary forming the major component of that secondary.

It has been discovered that this arrangement yields the result that each successive grouping of three about the central circle 10 comprises a palette comprised of tonally matched grouping of source colors to provide a tonally influenced palette.

It can be seen that the effect is to produce a set of basic color media which when combined in groups of a number corresponding to the number of primaries, these groups are inherently tonally related to each other.

For example, going about the central circle 10 to the left from the yellow colored segment, the successive basic colors are yellow-toned blue and red-toned gray. This is the tonal palette corresponding to the tonal influence of the yellow-green palette. That is, under the influence of yellow-green illumination, the red becomes gray-toned, while the blue becomes yellow-toned blue, and the yellow remains predominantly yellow, the toning effect of the yellow-green illumination on the yellow coloring being minimal.

Taking as another example the violet palette which is comprised of the yellow-toned gray, blue-toned red and the red-toned blue are those three colors which result from illumination of each primary with violet light, as indicated in FIG. 3.

The blue-violet palette which is immediately clockwise of the violet palette is comprised of blue-toned red and yellow-toned gray. The blue-violet illumination contains less red or a predominance of blue and hence, in this instance, the three source colors would be the blue, the blue-toned red and the yellow-toned gray, since, the blue source becomes somewhat more blue rendering the blue source color more appropriate as the primary color blue, while the primary red illuminated with blue-violet becomes more blue influenced to become a blue-toned red as a source primary. The yellow-toned gray is still appropriate since there is still a violet influence in the illumination to produce the graying of the yellow primary to render this source color appropriate for use in the palette.

Accordingly, instead of the six basic palettes which were theoretically produced by the illumination of three primary colors in FIG. 2 with the spectral range of illumination, by the ordering of the basic source colors in this fashion, a total number of twelve palettes can be directly produced.

In addition the changing of the tonal influence about the central circle 10 is in the same order as the traditional artist's color wheel. That is, there is provided the yellow, yellow-orange, orange, red-orange, red, red-violet, violet, blue-violet, blue and blue-green, green and yellow-green palettes. The artist's color wheel 12 is provided at each location corresponding to the palettes which may be produced by the adjacent basic coloring material or color group, located on either side of the location at which the artist's color wheel 12 is located in combination with the basic color at that location. The orientation of each color wheel is such that its position relates to the standard orientation of color wheels, i.e., the yellow sample region at the top, which likewise coincides with the color wheel formed by the grouping of the color wheel 12 about the central circle 10. Each color wheel includes segmental regions 16 of each color and radial regions 14 of each value of the color region.

It can be appreciated from this description of the color chart that placing the basic colors in this location relative to each other greatly increases the usefulness of these basic colors, inasmuch as a relatively large number of tonal palettes may be produced from a relatively few number of colors and which tonal palettes extend over the entire range of the spectrum and also are related to the usual color wheel spectral relationship. This result greatly enhances the understanding of beginners or novices of the concept of tonal influence and also when the actual coloring materials are related in this fashion, as will be described herein, provides a very ready selection of source colors which will produce such tonal palettes. This substantially eliminates the possibility of error in combining colors in a composition which are tonally unmatched, i.e., those which would not exist in the presence of an illumination of a given tone.

Additional palettes from those available from the combination of coloring materials corresponding to the chart of FIG. 4 can be derived from these basic coloring materials. These additional palettes are based on combinations of the tertiary or toned grays, one palette comprised of the entirely tertiary three-grayed primary colors and an additional nine palettes in which two gray tones are combined with one or the other ungrayed primary or secondary colors. The combination of the tertiary grays is, of course, harmonious with any of the other colors, since the tertiary grays contain a component of all of the primary or secondary colors.

Figure 5:
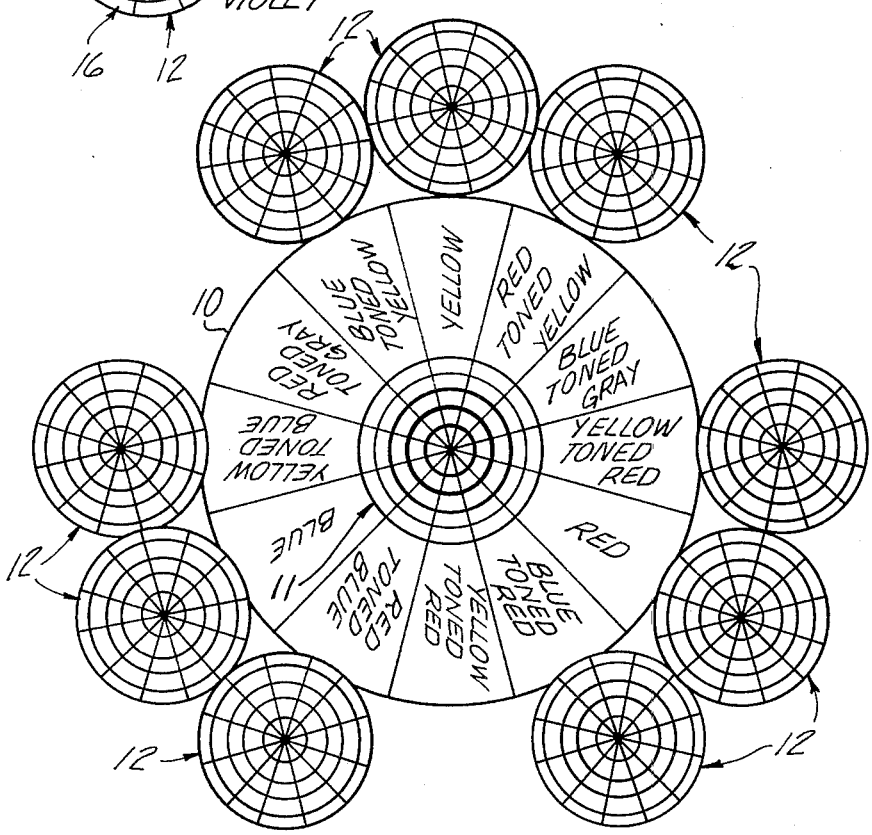
FIG. 5 is a diagrammatic representation of a supplemental color chart according to the present invention.

The color chart shown in FIG. 5 depicts graphically these combinations into "gray" palettes. Sample regions of each of the tertiary grays are equispaced about the central color wheel, with sample regions of each primary grouping interposed. Thus, combinations of each of the two tertiary gray media with each of the remaining primary and toned primary color media may comprise various gray palettes since each primary color is represented in the grouping. Similarly, all three tertiary grays may be grouped to provide an all-gray palette.

Artist's color wheels 12 are associated with the central color circle 10 in juxtaposition with each pure and toned primary sample region as shown, demonstrating the range of colors producible by combinations with the two other primary toned grays. A centrally located artist's color wheel 11 illustrates the combinations of the colors of the three tertiary gray color sample regions.

FIG. 6 shows a two axis rectangular array of the color samples corresponding to the twelve basic source color materials which may alternatively be used in lieu of the circular arrangement, depicted in FIG. 4. In this arrangement of the color chart 18, the various color samples are arranged along one axis of the rectangular array where it is described as the horizontal axis, as indicated, with various value gradations arranged along the other orthogonal axis.

Artists' color wheels may be associated with the basic coloring material locations in similar fashion to that of the color chart, shown in FIG. 4, the difference being that since the areas of the color samples do not run continuously into each other, those colors which would normally be juxtaposed must be provided at the end points in addition to the basic twelve. Hence, there will be required two additional areas at either end of the series to complete the three-color palette for the terminal color sample location at either end of the series.

Also, the physical similarity to the artist's color wheel of the various palettes is absent from this arrangement, but it may be preferably in some instances to use this format, since in connection with the coloring material packaging described below, a more compact package size may be achieved by a flat case and a rectangular array, as described.

Referring to FIGS. 6 through 9, a physical arrangement of such containers is depicted. It is contemplated in the practice of the present invention that the coloring materials be arranged in similar spatial relationship to the color charts described in FIGS. 4 and 5 as an aid in the ready selection of the appropriate coloring materials for any given palette selected.

Figure 7:
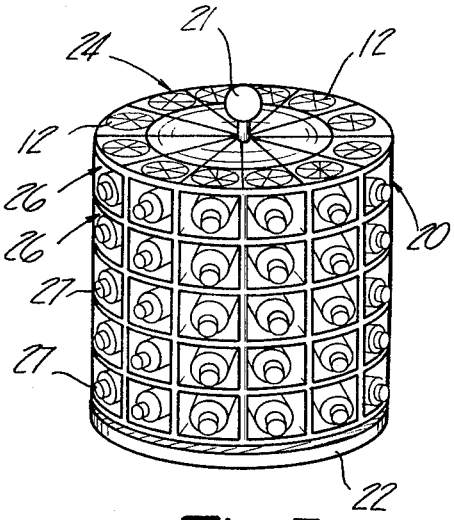
FIG. 7 is a perspective view of one form of storage unit for use with the system and color chart according to the present invention.

In FIG. 7, a carousel arrangement is described in which there is a cylindrical housing 20 supported on a base 22 and adapted to be rotated thereon in lazy susan fashion in order to provide convenient access. A knob 21 affixed to the housing 20 may be provided to enable convenient rotation of the housing 20. The housing 20 has an upper surface portion thereon 24 upon which would be advantageously printed or otherwise reproduced the color chart according the FIG. 4, with the respective artist's color wheels associated with each palette 12 disposed along the outer periphery thereof. Beneath each artist's color wheel location is a vertical array of radial compartments 26 in which are disposed coloring material containers such as oil pigment tubes of oil-based pigments 27. Each such color corresponds to one of the basic colors described above, with varying value gradations disposed along vertically descending compartments 26, so that a physical array of coloring materials corresponding to the spatial relationship defined by the color chart of FIG. 4 is provided.

Referring to FIG. 9, a flat rectangular array is provided which could conveniently be packaged as a carrying case 30 with a handle 32 affixed to its upper surface and a lid or cover 34 hinged to the lower edge thereof. In this case a rectangular array of compartments 36 is provided with the horizontal series of compartments holding containers of coloring material, such as the tubes 38 of differing colors according to the basic twelve colors described, with an additional two compartments provided at either horizontal end thereof in the series to complete the palette groupings associated with each color disposed in the end of the series, as described in connection with FIG. 5. A lower surface portion 40 is provided which carries the artist's color wheels associated with each palette grouping associated with each family of coloring materials.

To reduce the size of the cylinder or carousel unit, depicted in FIG. 7, a narrow width carousel unit, as shown in FIG. 8, can be provided including a cylindrical housing 42 which is of narrower diameter. In order to provide a surface space for the associated artist's color wheels a lower larger diameter base surface 44 is provided, upon which are imprinted the artist's color wheels 12. This approach would allow separate packaging and assembly of a relatively more compact carousel unit.

For applications such as water colors, a planar array may be advantageous, as shown in FIG. 10, comprising a disk 46 which is supported for rotation on a base (not shown). The disk 46 is subdivided into an outer annular area 48 and an inner concentric circular area 50. The outer annular area 48 has imprinted or otherwise reproduced thereon the series of artist's color wheels 12 together with associated areas of the appropriate basic coloring material 52. The inner circle 50 has disposed thereon at appropriate locations quantities of the coloring materials corresponding to the basic colors with alternating radial series 54 along which are disposed the various value gradations of the given basic coloring material, which intermediate the alternating radial series are clustered groupings 56 of the colors associated with that location, as shown. Thus, physical space is provided for associating a given artist's color wheel with a value collection of the appropriate coloring material corresponding to the twelve basic colors.

Any of these arrangements provides a very informative, convenient and expeditious aid in preparing a palette of paints in any given tonal selection preparatory to rendering of a color work. This is since the coloring materials provided in each grouping comprised of three sequentially located coloring materials inherently produces a tonally harmonious palette. Thus, it is no longer necessary for the artist to painstakingly, by eye, develop his basic palette by mixing of the coloring materials and additional relatively unlimited quantities of the palette colors are immediately available. The provision of the varying value gradations of these colors further almost completely elminates the need for this difficult, tedious and time-consuming task.

The use of the materials can be illustrated by reference to FIG. 11 in which a typical palette 58 has been prepared by the artist and is comprised of one each of a quantity of respective coloring material, the three successive colors providing the basic palette or source colors selected. The varying values would be advantageously disposed in rows beneath rows along the palette, i.e., red 1 through red 5, yellow 1 through yellow 5, blue 1 through blue 5. In order to obtain a desired hue, the source colors would be mixed across a similar value line to obtain values intermediate the values R1 through R5, the adjacent value levels would be mixed together to obtain intermediate values. This should only be done with adjacent value levels, since mixing of values not adjacent to one another will result in poor color. It is also possible to obtain intermediate values by mixing different basic colors with another color of a different value, as long as no more than one value gradation removed is utilized, i.e., R2 may be mixed with R3, B2 with R3, etc. It is possible to lighten the lightest values by providing a quantity of white coloring or darkening the darkest values by providing a quantity of black coloring material, and quantities of these colors (with instructions) may be provided as at 60, 62.

Accordingly, it can be seen that by the color system of the present invention a basic set of prepared or premixed coloring media are provided which are usable as source media for rendering color compositions which are realistic and natural and also take advantage of those subtleties of the color perceptive faculties which provide so-called visual entertainment to yield harmonious and pleasing color works.

Furthermore, the organization and selection of coloring materials is such as to enable the experienced to quickly proceed with the execution of a work, since he may use coloring materials directly as they are provided in this collection. Furthermore, the chart and coloring organization of the coloring materials provide a great aid for the beginning artist or student, since the concept of the interrelationship of colors in color compositions to produce the desired effects described above is greatly facilitated and also it is more easily understood.

Many variations of the concept are, of course, possible, as indeed, there is an infinite number of chart configurations which could be utilized on container configurations. In addition, the precise nature of the essential colors selected may be varied, as long as the broad relationship with the primary colors selected is met. Of course, the quality of the coloring materials would be enhanced with the purity of the colors provided but this is not essential in rendering the harmonious relationship of coloring materials produced by the present approach.

The embodiments of the invention in which an exclusive property or privilege is claimed are defined as follows:

1. A basic coloring material set for preparing tonally related source groupings of said coloring material comprising:

a quantity of each of three different colors of coloring materials comprising a primary set of colors;

a quantity of each of secondary coloring materials, each colored to correspond to each of said three different primary colors toned toward each of the other of said primary colors;

a quantity of each of a plurality of tertiary coloring materials, each colored in correspondence with the combination of all of said primary colors with each toned toward a respective one of said primary colors;

visual identification means associating each of said quantities of coloring materials in tonally related groupings of said coloring materials, said visual identification means including means ordering said quantities of coloring materials in a sequenced array, said array consisting of adjacent ordered subgroupings, each subgroup consisting of one each of said quantities of coloring materials of said three different primary colors, and two each of quantities of coloring materials of said secondary colors located on either side of each of said primary colors, each of said quantities of secondary coloring materials consisting of those secondary colors containing each of the other two primary colors toned by said one primary color in said subgroup; and, each of said subgroupings arranged with a quantity of coloring material of a tertiary color interposed between adjacent subgroups, each quantity of tertiary coloring material on either side of each subgroup consisting of said tertiary colors which are toned toward the other two of said primary colors not contained in the colors given in the subgroup disposed between said tertiary coloring materials;

whereby groupings of successive threes of said coloring materials in said sequenced array each consist of tonally related palettes, in that each of said coloring materials are consistently tonally influenced by a single color of a spectral range of colors.

2. The basic coloring material set according to claim 1 wherein said primary colors comprise red, blue and yellow coloring materials, and wherein said plurality of secondary colors comprise red-toned blue, blue-toned red, yellow-toned blue, blue-toned yellow, yellow-toned red, red-toned yellow coloring materials and wherein said tertiary colors comprise red-toned gray, blue-toned gray and yellow-toned gray coloring materials.

3. The basic coloring material set according to claim 1 wherein said primary colors of said coloring materials are comprised of red, blue and yellow coloring materials and wherein said plurality of secondary colors of said coloring materials comprised red-toned blue, blue-toned red, yellow-toned blue, blue-toned yellow, yellow-toned red, red-toned yellow coloring materials, and further wherein said plurality of tertiary colors of said coloring materials comprise red-toned gray, blue-toned gray and yellow-toned gray coloring materials, and wherein said means arranging said quantities of said coloring materials in a sequenced array comprises a successive ordering of said coloring materials in the order of yellow, yellow-toned red, gray-toned blue, red-toned yellow, red, red-toned blue, yellow-toned gray, blue-toned red, blue, blue-toned yellow, red-toned gray, yellow-toned blue, respectively, whereby successive groupings of three of said basic coloring material quantities comprise respectively the yellow-toned, yellow-orange-toned, red-orange-toned, red-toned, red-violet-toned, violet-toned, blue-violet toned, blue-toned, blue-green-toned, green-toned and yellow-green-toned palettes respectively, whereby tonal palettes may be provided throughout the spectral range from red to blue, each consisting of three of said basic coloring material set quantities.

4. The basic coloring material set according to claim 1 wherein said means locating quantities of said coloring material in said sequenced array includes means locating said quantities in a circular array.

5. The basic coloring material set according to claim 1 wherein said set further includes quantities of each of said basic coloring materials of varying values positioned in juxtaposition with respect to each other.

6. The basic coloring material set according to claim 1 wherein said means positioning said quantities of coloring materials in said array includes a support structure and wherein said set further includes a color chart carried by said support structure, said color chart comprising regions of samples of each of said basic coloring material colors, said regions being positioned in correspondence with the position of each of said respective basic coloring material quantities, respectively.

7. The basic coloring material set according to claim 6 wherein said color chart further includes an artist's color wheel associated with each of said color sample regions and consisting of a circular arrangement of regions of color samples produced by combinations of said basic coloring material colors.

8. The basic coloring material set according to claim 7 wherein said quantities of said coloring materials are arranged in a circular array and wherein said color chart includes a central circle divided into segments, each of which comprises said sample region oriented in correspondence with said circular array of said basic coloring material set.

9. The basic coloring material set according to claim 8 further including additional quantities of each of said coloring materials of various substantially equal values of each of said basic coloring material colors and wherein said chart includes additional regions concentrically arranged within said central circle having regions corresponding to each of said various values of said basic coloring material colors.

10. The basic coloring material set according to claim 9 wherein said primary set of primary colors consists of coloring materials of red, blue and yellow color and wherein said plurality of secondary colors comprise the red-toned blue, blue-toned red, blue-toned yellow, yellow-toned blue, yellow-toned red, red-toned yellow coloring materials, and wherein said colors of said tertiary colors comprise red-toned gray, blue-toned gray and yellow-toned gray and wherein said sample regions are arrayed in the following order: yellow, yellow-toned red, blue-toned gray, red-toned yellow, red, red-toned blue, yellow-toned gray, blue-toned red, blue, blue-toned yellow, red-toned gray, yellow-toned blue, and wherein said artist's color wheel comprises regions based on combinations of successive threes of said color sample regions, whereby each of said sets comprise tonal palettes corresponding to yellow, yellow-orange, orange, red-orange, red, red-violet, violet, blue-violet, blue, blue-green, green and yellow-green tones, respectively.

11. The basic coloring material set according to claim 1 further including a support structure for supporting quantities of said coloring material in said array, said support structure comprising a cylindrical housing having compartments arranged about the periphery thereof with a respective compartment provided to correspond to each of said quantities of said coloring material.

12. The basic coloring material set according to claim 11 wherein quantities of varying value of each of said colors in said basic coloring material set are provided and wherein said cylindrical housing further includes additional compartments extending along the length of said cylindrical housing periphery and wherein quantities of coloring material of like colors of varying value are disposed in said compartments along the length of said cylindrical housing.

13. The basic coloring material set according to claim 12 wherein said cylindrical housing includes a surface thereof carrying a color chart, said color chart comprised of samples of each of said basic coloring material set colors at locations on said surface about said cylindrical housing corresponding to said compartments containing said quantities of each of said basic coloring materials.

14. The basic coloring material set according to claim 13 wherein said color chart further includes radially displaced regions of each of said samples of basic color media colors of varying values thereof.

15. The basic coloring material set according to claim 14 wherein said color chart comprises a plurality of artist color wheels one associated with each of said regions wherein said samples of said basic color media colors are located, each of said artist color wheels displaying combinations of said sample color at said location with the basic color media sample colors immediately adjacent thereto at said location.

16. The basic coloring material set according to claim 14 whereat said cylindrical housing is supported on a disk surface and wherein said color chart arrangement is carried by said disk surface about the periphery thereof in correspondence with said compartments.

17. The basic coloring material set according to claim 1 further including a support structure for supporting said quantities of said basic coloring materials in said sequenced array, said support structure comprising a circular platform with said quantities of said basic coloring material disposed about the circumference of said circular platform.

18. The basic coloring material set according to claim 17 wherein said circular platform carries a color chart thereon, said color chart consisting of sample areas of each of said set colors located about the periphery of said circular platform at locations corresponding to said quantities of each of said coloring materials.

19. The basic coloring material set according to claim 1 wherein quantities of varying value of each of said basic coloring materials are provided in said sequenced array and further including a support structure for supporting said quantities of said basic coloring material in said array, said support structure comprising a rectangular case in which said array of each of said basic coloring material quantities are arranged in compartments along a first axis and wherein said quantities of varying value of each of said basic coloring materials are arranged along a second axis transverse thereto.

20. The basic coloring material set according to claim 19 wherein said primary coloring material colors are comprised of red, blue and yellow media wherein said plurality of secondary coloring material colors comprise red-toned blue, blue-toned red, yellow-toned blue, blue-toned yellow, yellow-toned red, red-toned yellow, and further wherein said plurality of tertiary coloring material colors comprise red-toned gray, blue-toned gray and yellow-toned gray color media, wherein said means arranging said quantities of said coloring material in said array comprises a successive ordering of said coloring material along one axis in the order of yellow, yellow-toned red, gray-toned blue, red-toned yellow, red-toned blue, yellow-toned gray, blue-toned red, blue, blue-toned yellow, red-toned gray, yellow-toned blue, respectively, whereby successive groupings of three of said basic coloring materials comprise respectively the yellow-toned, yellow-orange toned, orange-toned, red-orange-toned, red-toned, red-violet-toned, violet-toned, blue-violet-toned, blue-toned, blue-green-toned, green-toned, yellow-green-toned palettes, respectively, whereby tonal palettes may be provided throughout the spectral range from red to blue, each consisting of three of said basic coloring material set quantities.

21. The basic coloring material set according to claim 20 wherein said rectangular housing further includes a surface respectively bearing samples of each of said colors of said basic coloring material set and said samples of varying values thereof at locations corresponding to said array of compartments along each of said axes.

22. The basic coloring material set according to claim 1 wherein said sequenced array of said basic coloring material quantities comprises successive groupings of said basic coloring materials comprised of one of said primary colors and two of said secondary colors consisting of each of said secondary colors which are toned toward said primary color in said grouping, each of said groupings interposed with one of said quantities of tertiary coloring materials, each of said quantities of primary coloring material and said quantities of secondary coloring material ordered within said grouping such that each successive group in said array comprises source coloring material groupings.

23. The basic coloring material set according to claim 22 wherein said set includes three primary coloring materials and wherein each of said successive groupings comprises a quantity of one primary coloring material disposed intermediate to quantities of secondary coloring materials comprised of each of said other of said primary coloring material toned towards said one primary coloring material and wherein each of said quantities of secondary coloring material are disposed in juxtaposition with a quantity of one of said tertiary coloring material, said secondary coloring material immediately adjacent to each of said tertiary coloring material comprised of each of said secondary coloring material consisting of the primary colors of said other primary colors than said toning primary of said tertiary coloring material whereby each of said immediately adjacent quantities of secondary tertiary coloring materials consists of a three primary related grouping of said quantities of basic coloring material.

24. The basic coloring material set according to claim 23 wherein said quantities of primary, secondary and tertiary coloring materials are arranged in a circular arrangement.

* * * * *